US010176768B2

(12) United States Patent
Wang

(10) Patent No.: US 10,176,768 B2
(45) Date of Patent: Jan. 8, 2019

(54) LIQUID CRYSTAL DISPLAY AND COLOR SHIFT COMPENSATION METHOD OF LIQUID CRYSTAL DISPLAY

(71) Applicant: Shenzhen China Star Optoelectronics Technology Co., Ltd., Shenzhen, Guangdong (CN)

(72) Inventor: Mingliang Wang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 250 days.

(21) Appl. No.: 14/916,570

(22) PCT Filed: Jan. 6, 2016

(86) PCT No.: PCT/CN2016/070243
§ 371 (c)(1),
(2) Date: Mar. 4, 2016

(87) PCT Pub. No.: WO2017/101173
PCT Pub. Date: Jun. 22, 2017

(65) Prior Publication Data

US 2017/0301298 A1 Oct. 19, 2017

(30) Foreign Application Priority Data

Dec. 14, 2015 (CN) ..... 2015 1 0924858

(51) Int. Cl.
*G09G 3/36* (2006.01)
*G09G 3/20* (2006.01)

(52) U.S. Cl.
CPC ..... *G09G 3/3607* (2013.01); *G09G 3/2003* (2013.01); *G09G 3/3677* (2013.01);
(Continued)

(58) Field of Classification Search
CPC ..... G09G 2310/027; G09G 3/3696; G09G 3/3648; G09G 2320/0673;
(Continued)

(56) References Cited

U.S. PATENT DOCUMENTS 8,947,408 B2 * 2/2015 Lin ..... G09G 3/3688 345/204
2007/0197019 A1 * 8/2007 Kang ..... G02F 1/13454 438/620
2008/0158240 A1 * 7/2008 Huang ..... G09G 3/3648 345/589

FOREIGN PATENT DOCUMENTS

CN 101017297 A 8/2007
CN 101197111 A 6/2008
(Continued)

*Primary Examiner* — Duc Q Dinh
(74) *Attorney, Agent, or Firm* — Andrew C. Cheng

(57) ABSTRACT

The present invention discloses a liquid crystal display, including a data driving chip and a plurality of display regions, which are aligned side by side, and the data driving chip includes a digital to analog converter, and the digital to analog converter includes a plurality of voltage division modules which are individually independent, and the plurality of voltage division modules provide corresponding voltages for the plurality of display regions to achieve an identical brightness of the plurality of display regions. The present invention also discloses a color shift compensation method of a liquid crystal display. The display brightness of the liquid crystal display according to the present invention is identical.

6 Claims, 2 Drawing Sheets

(52) U.S. Cl.
CPC ..... *G09G 3/3685* (2013.01); *G09G 3/3688* (2013.01); *G09G 2310/027* (2013.01); *G09G 2310/0289* (2013.01); *G09G 2310/0291* (2013.01); *G09G 2320/0233* (2013.01); *G09G 2320/0242* (2013.01); *G09G 2320/0666* (2013.01); *G09G 2320/0693* (2013.01)

(58) Field of Classification Search
CPC ..... G09G 2320/0276; G09G 3/3607; G09G 2300/043; G09G 2300/0443; G09G 2310/0275; G09G 2310/0291; G09G 2320/0233; G09G 2320/0242; G09G 2320/0271; G09G 3/3291; G09G 2300/0809; G09G 3/3659; G09G 2310/0248; G09G 2310/0289; G09G 3/2092; G09G 3/3266; G09G 3/3655; G09G 3/3674; G09G 2310/0205; G09G 2330/02; G09G 3/3275; G09G 3/3283; G09G 2320/0223; G09G 2320/0257; G09G 2320/029; G09G 2340/0428; G09G 3/3685; G09G 5/006; G09G 2320/0247; G09G 2320/0666; G09G 3/3413; G09G 2320/0626; G09G 2360/16; G09G 3/2003; G09G 3/3666
USPC ..... 345/88, 89, 98–100
See application file for complete search history.

(56) References Cited

FOREIGN PATENT DOCUMENTS

| | | | |
|---|---|---|---|
| CN | 101582242 | A | 11/2009 |
| CN | 102592567 | A | 7/2012 |
| CN | 102930816 | A | 2/2013 |
| CN | 103943088 | A | 7/2014 |
| KR | 20060086170 | A | 7/2006 |

* cited by examiner

LIQUID CRYSTAL DISPLAY AND COLOR SHIFT COMPENSATION METHOD OF LIQUID CRYSTAL DISPLAY

CROSS REFERENCE

This application claims the priority of Chinese Patent Application No. 201510924858.1, entitled "Liquid crystal display and color shift compensation method of liquid crystal display", filed on Dec. 14, 2015, the disclosure of which is incorporated herein by reference in its entirety.

FIELD OF THE INVENTION

The present invention relates to a display technology field, and more particularly to a liquid crystal display and a color shift compensation method of liquid crystal display.

BACKGROUND OF THE INVENTION

The liquid crystal display has been widely applied due to it light weight, thin thickness and small power consumption. Because of the driving structure of the liquid crystal display and the resistance delay of the cell wire, the region closer to the gate driving chip (Gate Driver) is charged more sufficiently, and the display brightness is brighter, and the region away from the gate driving chip is charged less, and the display brightness is weaker. Thus, the different regions of the liquid crystal display express different brightnesses, which is the color shift issue that always exists for the liquid crystal display. With the development trench of the large scale, high resolution liquid crystal display, the color shift issue of the liquid crystal display becomes more serious.

At present, the insiders generally add one data compensation module in the sequence control chip (TCON) for achieving the compensation to the data at left, right two sides of the screen to diminish the color shift condition of the liquid crystal display. However, the solution also correspondingly raises the cost of the sequence control chip and the power consumption uprising problem.

SUMMARY OF THE INVENTION

An objective of the present invention is to provide a liquid crystal display of which the screen brightness is identical and a color shift compensation method of a liquid crystal display for reducing the color shift levels of different regions of the liquid crystal display.

For realizing the aforesaid objective, the technical solution utilized by the embodiments of the present invention is:

First, provided is a liquid crystal display, comprising a data driving chip and a plurality of display regions, which are aligned side by side, and the data driving chip comprises a digital to analog converter, and the digital to analog converter comprises a plurality of voltage division modules which are individually independent, and the plurality of voltage division modules provide corresponding voltages for the plurality of display regions to achieve an identical brightness of the plurality of display regions.

The plurality of display regions comprises a first display region in the middle of the liquid crystal display and a plurality of second display regions arranged at two sides of the first display region, and the plurality of voltage division modules comprises a first voltage division module and a plurality of second voltage division modules, and the first voltage division module provides a voltage for the first display region, and the plurality of second voltage division modules provides voltages for the plurality of second display regions one to one or one to two, and the two second display regions which commonly share the same second voltage division module are symmetric relative to the first display region.

The liquid crystal display comprises a gate driving chip located at one side of the plurality of display regions, and the plurality of second voltage division modules provides voltages for the plurality of second display regions one to one.

The liquid crystal display comprises two gate driving chips respectively located at two sides of the plurality of display regions, and the plurality of second voltage division modules provides voltages for the plurality of second display regions one to two.

Both the first voltage division module and the second voltage division module comprise a resistance string which is formed with a plurality of resistance coupled in series, and the resistance string generates a plurality of voltages, and the resistance strings of the first voltage division module and the second voltage division module are different.

The data driving chip further comprises a logic control module and an output power amplifying module, and the logic control module is employed to output a digital signal to the digital to analog converter, and the digital to analog converter converts the digital signal into a voltage signal, and then inputs the same into the output power amplifying module, and the output power amplifying module amplifies the voltage signal, and outputs the voltage to the plurality of display regions for driving the plurality of display regions to display.

Second, provided is a color shift compensation method of a liquid crystal display, wherein the color shift compensation method of the liquid crystal display comprises steps of:

dividing the liquid crystal display into a plurality of display regions;

providing a voltage corresponding to a first gray scale for the plurality of display regions with a first voltage division module;

respectively measuring brightnesses of the plurality of display regions, and determining actual voltages of the plurality of display regions;

the plurality of display regions comprises a first display region and a plurality of second display regions;

respectively providing compensation voltages for the plurality of second display regions to obtain correction voltages of the plurality of second display regions corresponding to the first gray scale, and the compensation voltages are differences between the actual voltage of the first display region and the actual voltage of the second display regions;

repeating the aforesaid steps to obtain correction voltages of the plurality of second display regions corresponding to other gray scales except the first gray scale;

providing a voltage for the first display region with the first voltage division module, and providing the correction voltages for the plurality of second display regions with the plurality of second voltage division modules to make a display brightness of the liquid crystal display identical.

After measuring the brightnesses of the plurality of display regions, the method comprises: finding the actual voltages corresponding to the brightnesses according to a voltage-transmission (V-T) curve of liquid crystal.

The first display region is in the middle of the liquid crystal display, and the plurality of second display regions arranged at two sides of the first display region.

The liquid crystal display comprises a gate driving chip located at one side of the plurality of display regions, and the plurality of second voltage division modules provides voltages for the plurality of second display regions one to one.

The liquid crystal display comprises two gate driving chips respectively located at two sides of the plurality of display regions, and the plurality of second voltage division modules provides voltages for the plurality of second display regions one to two, and the two second display regions which commonly share the same second voltage division module are symmetric relative to the first display region.

Both the first voltage division module and the second voltage division module comprise a resistance string which is formed with a plurality of resistance coupled in series, and the resistance string generates a plurality of voltages, and the resistance strings of the first voltage division module and the second voltage division module are different.

Compared with prior art, the present invention possesses benefits below:

The liquid crystal display according to the embodiment of the present invention provides corresponding voltages for the plurality of display regions by locating a plurality of voltage division modules which are independent with one another. Namely, by locating various voltage division modules to provide respective required voltages for the various display regions, the brightnesses of the plurality of display regions are identical to solve the color shift issue of different display regions as the liquid crystal display according to prior art performs display.

In the color shift compensation method of the liquid crystal display according to the embodiment of the present invention, the display region of the liquid crystal display is divided into a plurality of display regions, and the digital to analog converter comprises a plurality of voltage division modules which are independent from one another, and the plurality of voltage division modules are implemented with compensation design according to the respective actual charging conditions of the plurality of display regions to make the brightness of the display region of the liquid crystal display identical after the outputting voltages to the plurality of display regions for solving the color shift issue of different display regions as the liquid crystal display according to prior art performs display. Meanwhile, the display region in the middle region of the liquid crystal display is considered as the first display region, and other display regions are the second display regions in the embodiment. The display brightness of the display region in the middle region of the liquid crystal display generally can achieve the best display result of the liquid crystal display. Accordingly, the compensation voltages of the plurality of second display regions based on that are more accurate. Therefore, the obtained correction voltages can make the liquid crystal display have better display result.

BRIEF DESCRIPTION OF THE DRAWINGS

In order to more clearly illustrate the embodiments of the present invention, the following figures will be described in the embodiments are briefly introduced. It is obvious that the drawings are only some embodiments of the present invention, those of ordinary skill in this field can obtain other figures according to these figures without paying the premise.

DETAILED DESCRIPTION OF PREFERRED EMBODIMENTS

For better explaining the technical solution and the effect of the present invention, the present invention will be further described in detail with the accompanying drawings in the specific embodiments.

Figure 1:
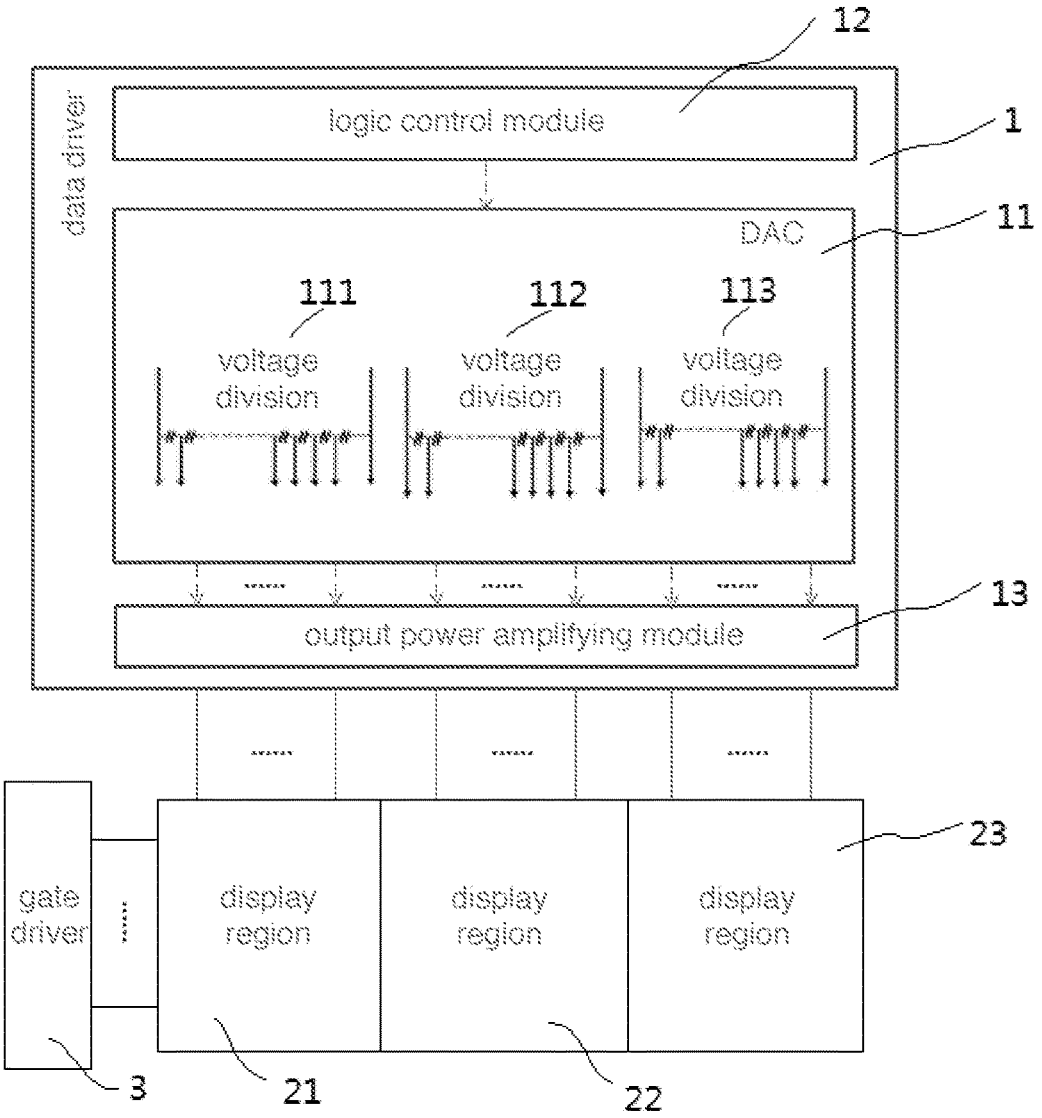
FIG. 1 is a structure diagram of a liquid crystal display provided by the embodiment of the present invention.

Please refer to FIG. 1. The embodiment of the present invention provides a liquid crystal display, comprising a data driving chip (Date Driver) 1 and a plurality of display regions (21, 22, 23), which are aligned side by side, and the data driving chip 1 comprises a digital to analog converter (DAC) 11, and the digital to analog converter 11 comprises a plurality of voltage division modules (111, 112, 113) which are individually independent from one another, and the plurality of voltage division modules (111, 112, 113) provide corresponding voltages for the plurality of display regions (21, 22, 23) to achieve an identical brightness of the plurality of display regions (21, 22, 23).

In this embodiment, the liquid crystal display provides corresponding voltages for the plurality of display regions by locating a plurality of voltage division modules which are independent with one another. Namely, by locating various voltage division modules to provide respective required voltages for the various display regions, the brightnesses of the plurality of display regions are identical to solve the color shift issue of different display regions as the liquid crystal display according to prior art performs display.

In prior arts, the data driving chip of the liquid crystal display generally comprises only one voltage division module, and this voltage division module provides voltages for the entire display region of the liquid crystal display at the same time. Then, if the gate driving chip (Gate Driver) is merely located at one side, the condition that the charging condition is gradually decreased or increased from one side of the display region to the other side can easily occur. Namely, the display brightness will be bright to dark or dark to bright from one side of the display region to the other side; in case that the gate driving chips are located at two sides at the same time, the condition that the two sides of the display region are sufficiently charged, and the middle of the display region is insufficiently charged can easily occur, i.e. the brightness of the two sides of the display region is brighter, and the brightness of the middle of the display region is darker. Therefore, in prior art, the liquid crystal display with the larger display region commonly happens the color shift issue, and with the area increase of the display region, the color shift issue can be more serious.

However, in this embodiment, referring to FIG. 1 for instance, the display region of the liquid crystal display is divided into a display region 21, a display region 22 and a display region 23. The digital to analog converter 11 comprises a voltage division module 111, a voltage division module 112 and a voltage division module 113. The voltage division module 111, the voltage division module 112 and the voltage division module 113 can be implemented with compensation design according to the respective charging conditions of the display region 21, the display region 22 and the display region 23 so that after the voltages are outputted to the display region 21, the display region 22 and the display region 23, the brightness of the display region of the liquid crystal display maintains identical. Specifically, as the gate driving chip 3 is located at one side of the liquid crystal display close to the display region 21, and the display region 21, the display region 22 and the display region 23 are driven by the same gate line. The charging degrees of the display region 21, the display region 22 and the display region 23 decreases in order. Then, the respective brightnesses of the display region 21, the display region 22 and the display region 23 at the same gray scale signal can be measured, and the corresponding actual voltages V1, V2, V3 of the display region 21, the display region 22 and the display region 23 are found with the voltage-transmission (V-T) curve of liquid crystal. For better achieving the display result of identical brightness of the liquid crystal display, the actual voltage V2 of the display region 22 in the middle region of the liquid crystal display is the reference voltage. The operations of the compensation voltages are performed to the display region 21 and the display region 23. The compensation voltage of the display region 21 is ΔV1=V2−V1, and the compensation voltage of the display region 23 is ΔV3=V2−V3. Moreover, the aforesaid compensation voltages are respectively compensated to the received voltages of the respective corresponding display regions to obtain the correction voltages. Furthermore, the designed is implemented to the voltage division module 111 and the voltage division module 113 to make them output correction voltages at the same gray scale signal. Therefore, the liquid crystal display locates respective corresponding voltage division modules (111, 112, 113) for the various display regions (21, 22, 23) to make these receive the accurate voltages (i.e. the correction voltages) so that the plurality of display regions can maintain the brightness to be identical to solve the color shift issue of different display regions as the liquid crystal display according to prior art performs display.

It should be understood that the aforesaid embodiment only explains the condition of dividing the display region of the liquid crystal display into three display regions. The amount of the display regions can be flexibly arranged and divided (certainly, in normal condition, the amount of the display regions is larger than or equal to 3) for the display region of the liquid crystal display according to various demands of the practical conditions (such as the dimension of the liquid crystal display). Meanwhile, the amount of the voltage division modules is correspondingly arranged. Certainly, the more the amount of the display regions is, the more the voltage division modules gets. Although a better display result can be obtained, the cost of the data driving chip is increased in certain level. Thus, the display result, the cost should be overall considered as dividing the display regions for reasonably dividing the display regions, and arranging the amount of the voltage division modules. Meanwhile, in the aforesaid embodiment, the brightness state of the display region 22 is employed to be the reference for implementing the compensation design. As it should be, the present invention can utilizes the other brightness state to be the reference. For instance, some brightness is set to be the reference, and the corresponding reference voltage is V. Then, the compensation voltages of the display region 21, the display region 22 and the display region 23 respectively are ΔV1=V−V1, ΔV2=V−V2 and ΔV3=V−V3. The aforesaid compensation voltages are respectively compensated to the received voltages of the respective corresponding display regions to obtain the correction voltages. Therefore, which display regions are compensated, and how many are the compensation voltages can be flexibly arranged according to the practical demands. No restriction is claimed here in the embodiment of the present invention.

Furthermore, the plurality of display regions comprises one first display region in the middle of the liquid crystal display and a plurality of second display regions arranged at two sides of the first display region, and the plurality of voltage division modules comprises a first voltage division module and a plurality of second voltage division modules, and the first voltage division module provides a voltage for the first display region, and the plurality of second voltage division modules provides voltages for the plurality of second display regions one to one or one to two, and the two second display regions which commonly share the same second voltage division module are symmetric relative to the first display region. In this embodiment, the first display region in the middle of the liquid crystal display is employed to be the reference region. The first voltage division module provides the voltage for the first display region, i.e. the first voltage division module is the reference voltage division module. The plurality of second voltage division modules are implemented with compensation design on the basis of the first voltage division module, and provide the correction voltages. As an illustration, referring to FIG. 1, the display region 22 is set to be the first display region, and the display region 21, the display region 23 are the second display regions. The voltage division module 112 is the first voltage division module, and the voltage division module 111 and the voltage division module 113 are the second voltage division modules. By calculating the voltage difference corresponding to the brightnesses of the second display regions (the display region 21, the display region 23) and the first display region (display region 22), the compensation voltages of the second display regions (the display region 21, the display region 23) are obtained. The aforesaid compensation voltages are fed back to the design of the second voltage division modules (voltage division module 111 and the voltage division module 113) to make the second voltage division modules (voltage division module 111 and the voltage division module 113) output the correction voltages.

Furthermore, referring to FIG. 1, the liquid crystal display comprises a gate driving chip 3 located at one side of the plurality of display regions. The plurality of second voltage division modules (111, 113) provide voltages for the plurality of second display regions (21, 23) one to one. Namely, if the liquid crystal display utilizes only the single side gate driving chip for driving. The color shift levels of the plurality of second display regions are different. Thus, the plurality of second voltage division modules provide the voltages for the plurality of second display regions one to one for achieving the objective of identical display brightness of the entire liquid crystal display.

It is understood that the liquid crystal display can comprise two gate driving chips respectively located at two sides of the plurality of display regions (not shown in figure of this embodiment). Therefore, the color shift levels of one set of second display regions which are symmetric relative to the first display region are often closer. The plurality of second voltage division modules provides voltages for the plurality of second display regions one to two, and the two second display regions which commonly share the same second voltage division module are symmetric relative to the first display region to reduce the amount of the second voltage division modules, and thus to reduce the production cost of the liquid crystal display.

Furthermore, both the first voltage division module and the second voltage division module comprise a resistance string which is formed with a plurality of resistance coupled in series, and the resistance string generates a plurality of voltages, and the resistance strings of the first voltage division module and the second voltage division module are different. Namely, the resistance string is the structure formation of the voltage division modules in the embodiment. The operations and designs can be implemented to the connection and the resistance values of the respective resistances for the resistance string according to the required voltages with combination of the voltage division principle of series resistance (in series circuit, the current of the respective resistance are equal, and the sum of the voltages at two ends of the respective resistances is equal to the total voltage of the circuit). Because the different voltage division modules are employed for providing different voltages, the designs for the respective resistance strings are different.

Furthermore, the data driving chip 1 further comprises a logic control module 12 and an output power amplifying module 13, and the logic control module 12 is employed to output a digital signal to the digital to analog converter 11, and the digital to analog converter 11 converts the digital signal into a voltage signal, and then inputs the same into the output power amplifying module 13, and the output power amplifying module 13 amplifies the voltage signal, and outputs the voltage to the plurality of display regions for driving the plurality of display regions to display.

The embodiment of the present invention further provides a color shift compensation method of a liquid crystal display, wherein the color shift compensation method of the liquid crystal display comprises steps of:

dividing the liquid crystal display into a plurality of display regions;

providing a voltage corresponding to a first gray scale for the plurality of display regions with a first voltage division module;

respectively measuring brightnesses of the plurality of display regions, and determining actual voltages of the plurality of display regions;

the plurality of display regions comprises a first display region and a plurality of second display regions;

respectively providing compensation voltages for the plurality of second display regions to obtain correction voltages of the plurality of second display regions corresponding to the first gray scale, and the compensation voltages are differences between the actual voltage of the first display region and the actual voltage of the second display regions;

repeating the aforesaid steps to obtain correction voltages of the plurality of second display regions corresponding to other gray scales except the first gray scale;

providing a voltage for the first display region with the first voltage division module, and providing the correction voltages for the plurality of second display regions with the plurality of second voltage division modules, and the voltages make a display brightness of the liquid crystal display identical.

Figure 2:
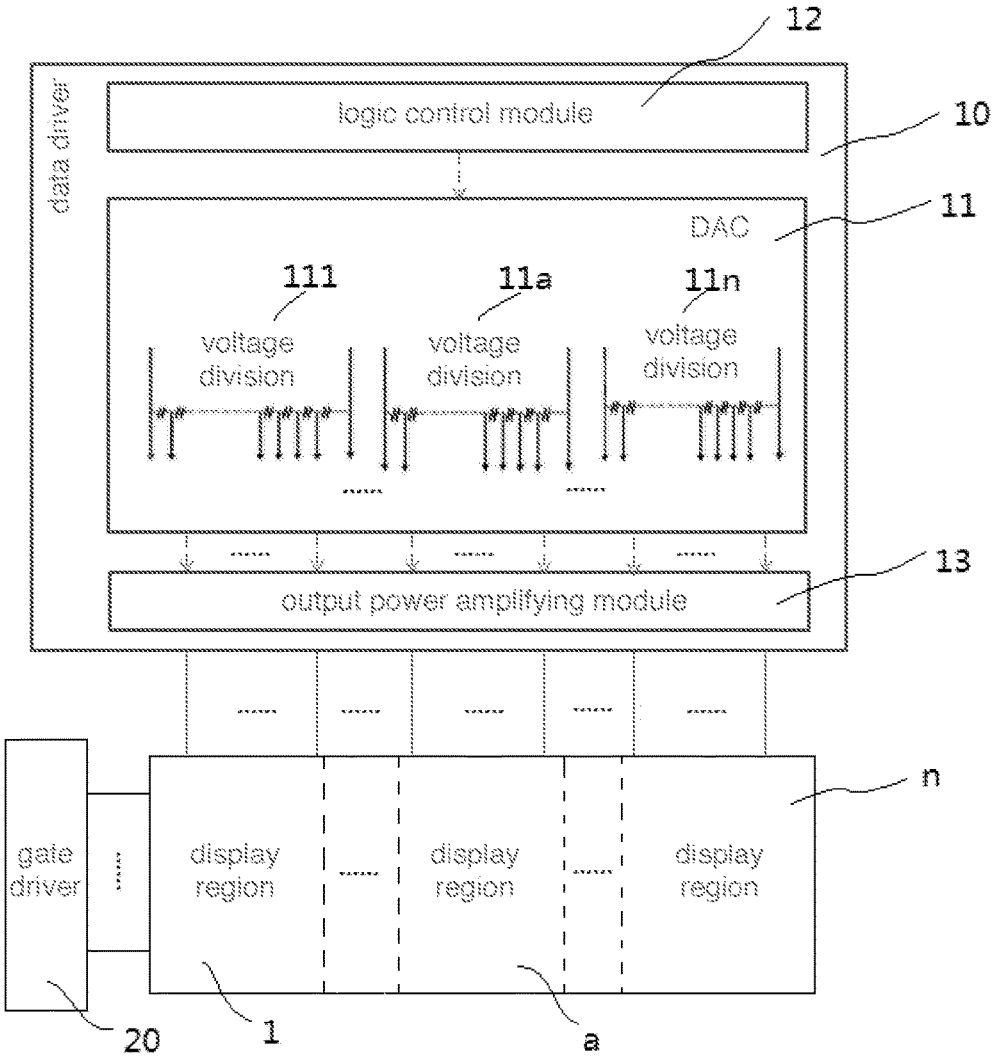
FIG. 2 is structure diagram of a liquid crystal display in a color shift compensation method of a liquid crystal display provided by the embodiment of the present invention.

As an illustration, referring to FIG. 2, the color shift compensation method of the liquid crystal display comprises steps of:

dividing the liquid crystal display into a plurality of display regions 1-n (n is a integer larger than or equal to 3), providing a voltage corresponding to a first gray scale for the plurality of display regions 1-n with a first voltage division module 11a (a is a positive integer);

respectively measuring brightnesses of the plurality of display regions 1-n, and determining actual voltages V1−Vn of the plurality of display regions 1-n (n is a integer larger than or equal to 3);

the plurality of display regions 1-n comprises a first display region a in the middle of the liquid crystal display and a plurality of second display regions [1, a)U(a, n] arranged at two sides of the first display region a; respectively providing compensation voltages for the plurality of second display regions [1, a)U(a, n] to obtain correction voltages of the plurality of second display regions [1, a)U(a, n] corresponding to the first gray scale, and the compensation voltages [ΔV1, ΔVa)U(ΔVa, ΔVn] are differences between the actual voltage V of the first display region a and the actual voltage [V1, V)U(V, Vn] of the second display regions, i.e. ΔV1=V−V1, ΔV2=V−V2 . . . ΔVn=V−Vn;

repeating the aforesaid steps to obtain correction voltages of the plurality of second display regions [1, a)U(a, n] corresponding to other gray scales except the first gray scale;

providing a voltage for the first display region a with the first voltage division module 11a, and providing the correction voltages for the plurality of second display regions [1, a)U(a, n] with the plurality of second voltage division modules [111, 11a)U(11a, 11n] to make a display brightness of the liquid crystal display identical.

In this embodiment, with the aforesaid color shift compensation method of the liquid crystal display, the display region of the liquid crystal display is divided into a plurality of display regions 1-n, and the digital to analog converter 11 comprises a plurality of voltage division modules 111-11n which are independent from one another, and the plurality of voltage division modules 111-11n are implemented with compensation design according to the respective actual charging conditions of the plurality of display regions 1-n to make the brightness of the display region of the liquid crystal display identical after the outputting voltages to the plurality of display regions 1-n for solving the color shift issue of different display regions as the liquid crystal display according to prior art performs display. Meanwhile, the display region a in the middle region of the liquid crystal display is considered as the first display region, and other display regions [1, a)U(a, n] are the second display regions in the embodiment. The display brightness of the display region a in the middle region of the liquid crystal display generally can achieve the best display result of the liquid crystal display. Accordingly, the compensation voltages of the plurality of second display regions based on that are more accurate. Therefore, the obtained correction voltages can make the liquid crystal display have better display result.

It should be understood that in this embodiment, the set [1, a)U(a, n] is a integer set of 1 to n and includes end point 1 and n, not including the end point a; similarly, the other sets in this embodiment also represent the same meaning. The repeated description is omitted here. Meanwhile, the first display region (reference display region) is employed to be the middle region in this embodiment. It should be understood that the other display regions can be selected to be the reference display region according the practical demands.

Furthermore, after measuring the brightnesses of the plurality of display regions, the method comprise: finding the actual voltages corresponding to the brightnesses according to a voltage-transmission (V-T) curve of liquid crystal.

Furthermore, the plurality of second voltage division modules provides voltages for the plurality of second display regions one to one or one to two, and the two second display regions which commonly share the same second voltage division module are symmetric relative to the first display region. Specifically, referring to FIG. 2, the liquid crystal display comprises a gate driving chip 20 located at one side of the plurality of display regions. The plurality of second voltage division modules [111, 11a)U(11a, 11n] provide voltages for the plurality of second display regions [1, a)U(a, n] one to one. Namely, if the liquid crystal display utilizes only the single side gate driving chip for driving. The color shift levels of the plurality of second display regions are different. Thus, the plurality of second voltage division modules provide the voltages for the plurality of second display regions one to one for achieving the objective of identical display brightness of the entire liquid crystal display. It is understood that the liquid crystal display can comprise two gate driving chips respectively located at two sides of the plurality of display regions (not shown in figure of this embodiment). Therefore, the color shift levels of one set of second display regions which are symmetric relative to the first display region are often closer. The plurality of second voltage division modules provides voltages for the plurality of second display regions one to two, and the two second display regions which commonly share the same second voltage division module are symmetric relative to the first display region to reduce the amount of the second voltage division modules, and thus to reduce the production cost of the liquid crystal display.

Furthermore, both the first voltage division module and the second voltage division module comprise a resistance string which is formed with a plurality of resistance coupled in series, and the resistance string generates a plurality of voltages, and the resistance strings of the first voltage division module and the second voltage division module are different. Namely, the resistance string is the structure formation of the voltage division modules in the embodiment. The operations and designs can be implemented to the connection and the resistance values of the respective resistances for the resistance string according to the required voltages with combination of the voltage division principle of series resistance (in series circuit, the current of the respective resistance are equal, and the sum of the voltages at two ends of the respective resistances is equal to the total voltage of the circuit). Because the different voltage division modules are employed for providing different voltages, the designs for the respective resistance strings are different.

Furthermore, the data driving chip 10 further comprises a logic control module 12 and an output power amplifying module 13, and the logic control module 12 is employed to output a digital signal to the digital to analog converter 11, and the digital to analog converter 11 converts the digital signal into a voltage signal, and then inputs the same into the output power amplifying module 13, and the output power amplifying module 13 amplifies the voltage, and outputs the same to the plurality of display regions for driving the plurality of display regions to display.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A color shift compensation method of a liquid crystal display, comprising the following steps:

dividing the liquid crystal display into a plurality of display regions that comprises a first display region and a plurality of second display regions and are all driven by a same gate line;

providing a voltage corresponding to a first gray scale to the plurality of display regions;

measuring a brightness level of each of the plurality of display regions, and determining actual voltages of the plurality of display regions corresponding to the brightness level;

providing a compensation voltage for each of the plurality of second display regions to obtain a correction voltage of each of the plurality of second display regions corresponding to the first gray scale, wherein the compensation voltage is a difference between the actual voltage of the first display region and the actual voltage of each of the plurality of second display regions; and providing the voltage to the first display region and providing the correction voltage to each of the plurality of second display regions so as to make the brightness level of each of the plurality of second display regions of the liquid crystal display that is provided with the correction voltage identical to the brightness level of the first display region of the liquid crystal display.

2. The color shift compensation method of the liquid crystal display according to claim 1, wherein the actual of each of the plurality of display regions is determined by the brightness level thereof according to a voltage-transmission (V-T) curve of liquid crystal.

3. The color shift compensation method of the liquid crystal display according to claim 2, wherein the first display region is arranged in a middle portion of the liquid crystal display, and the plurality of second display regions are arranged at two sides of the first display region.

4. The color shift compensation method of the liquid crystal display according to claim 3, wherein the liquid crystal display comprises a gate driving chip located at one side of the plurality of display regions, and the plurality of second display regions are provided with the correction voltages from independent sources.

5. The color shift compensation method of the liquid crystal display according to claim 3, wherein the liquid crystal display comprises two gate driving chips respectively located at two sides of the plurality of display regions, and the plurality of second display regions that are arranged at two sides of the first display region are symmetrically arranged on the two sides of the first display region, such that each of the second display regions at a first side of the first display region is associated with one of the second display regions at a second side of the first display region and the second display region of the first side and the second display region of the second side receive the correction voltages from a common source.

6. The color shift compensation method of the liquid crystal display according to claim 1, wherein the voltage is provided from a first voltage division module to the first display region and the correction voltages are respectively provided from second voltage division modules to the second display regions, wherein the first and second voltage division modules each comprise a resistance string which is formed with a plurality of resistors coupled in series, such that the resistance string generates a plurality of voltages, and wherein the resistance strings of the first voltage division module and the second voltage division modules are different.

* * * * *